US008443909B2

(12) United States Patent
Wong

(10) Patent No.: US 8,443,909 B2
(45) Date of Patent: May 21, 2013

(54) INSULATED FIRE SHUTTER

(75) Inventor: Lok Yung Wong, Singapore (SG)

(73) Assignee: Gliderol Doors (S) Pte Ltd, Singapore (SG)

( * ) Notice: Subject to any disclaimer, the term of this patent is extended or adjusted under 35 U.S.C. 154(b) by 0 days.

(21) Appl. No.: 13/127,429

(22) PCT Filed: May 14, 2010

(86) PCT No.: PCT/SG2010/000182

§ 371 (c)(1),
(2), (4) Date: May 16, 2011

(87) PCT Pub. No.: WO2011/016779

PCT Pub. Date: Feb. 10, 2011

(65) Prior Publication Data

US 2011/0284249 A1 Nov. 24, 2011

(30) Foreign Application Priority Data

Aug. 5, 2009 (SG) ..... 200905226-7

(51) Int. Cl.

| | |
|---|---|
| ***A62C 8/00*** | (2006.01) |
| ***A62C 3/00*** | (2006.01) |
| ***E06B 9/08*** | (2006.01) |
| ***E05D 15/06*** | (2006.01) |
| ***A47H 3/00*** | (2006.01) |

(52) U.S. Cl.
USPC ..... 169/48; 169/54; 169/91; 160/133; 160/194; 160/195; 160/271

(58) Field of Classification Search
USPC ..... 169/48, 54, 91; 160/133, 194, 195, 160/269, 271
See application file for complete search history.

(56) References Cited

U.S. PATENT DOCUMENTS 5,188,186 A * 2/1993 Nash ..... 169/48
5,720,333 A * 2/1998 Turvey ..... 160/290.1

(Continued)

FOREIGN PATENT DOCUMENTS

DE 1203444 * 10/1965
DE 1203444 B 10/1965

(Continued)

OTHER PUBLICATIONS

International Search Report issued in PCT Application No. PCT/SG2010/000182, dated Sep. 2, 2010, 4 pages.

(Continued)

*Primary Examiner* — Ryan Reis
(74) *Attorney, Agent, or Firm* — Harness, Dickey & Pierce, P.L.C.

(57) ABSTRACT

A fire shutter adapted to close off an area comprises a shutter curtain movable from an up position to a closed position, wherein the shutter curtain closes off the area when in the closed position, and at least one retractable guide, movable from a retracted position to an extended position and having a camber. The shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position. The shutter curtain can also comprise front slats and rear slats, and an insulation package can be deployable from a non-deployed position to a deployed position within a space between the front slats and the rear slats.

21 Claims, 5 Drawing Sheets

U.S. PATENT DOCUMENTS

| | | | | |
|---|---|---|---|---|
| 5,862,851 | A | 1/1999 | Stoebich et al. | |
| 6,427,749 | B1 * | 8/2002 | Swink et al. | 160/188 |
| 6,571,851 | B1 | 6/2003 | Jelic et al. | |
| 6,834,464 | B2 * | 12/2004 | Shoemaker | 49/449 |
| 2006/0021715 | A1 | 2/2006 | Nien | |

FOREIGN PATENT DOCUMENTS

| | | | |
|---|---|---|---|
| EP | 0003728 | A1 | 9/1979 |
| GB | 121258 | | 12/1918 |
| JP | 11-89952 | | 6/1999 |
| JP | 2003-247383 | A | 9/2003 |

OTHER PUBLICATIONS

International Preliminary Report on Patentability (and claim amendments submitted with demand for examination) issued in PCT Application No. PCT/SG2010/000182, dated Dec. 7, 2010, 7 pages.

International Property Office of Singapore Search and Examination Report issued in Singapore Application SG200905226-7, dated Nov. 23, 2010, 10 pages.

International Search Report issued in PCT Application No. PCT/SG2010/000182, dated Sep. 2, 2010, 5 pages.

* cited by examiner

INSULATED FIRE SHUTTER

CROSS-REFERENCE TO RELATED APPLICATIONS

This application is a U.S. national stage filing under 35 U.S.C. §371 of International Application No. PCT/SG2010/000182 filed May 14, 2010, which published as WO 2011/016779 on Feb. 10, 2011, and which claims priority to Singapore Application No. 200905226-7 filed Aug. 5, 2009. The disclosures of each of the above applications are incorporated herein by reference in their entireties.

FIELD OF THE INVENTION

This invention pertains to fire shutters, more particularly to fire shutters which effectively resist heat transfer.

BACKGROUND OF THE INVENTION

Fire can spread extremely quickly if it is not properly contained. It is therefore desirable that openings such as doors or windows in buildings or vehicles are provided with ways for preventing flames from passing through them. Fire doors or shutters must be capable of resisting the effects of a fire for a period of time often stipulated by regulations. However, enormous heat can be generated by such fires. Known fire shutters are uninsulated. When subjected to the effects of fire, they can turn red hot and emit radiated heat to the other side of an opening, thus allowing the fire to spread. It would be desirable to provide a fire shutter which meets both requirements for prevention of transmission of fire and also resists heat transfer during such fires—i.e., acts as an insulating device.

SUMMARY OF THE INVENTION

In accordance with a first aspect, a fire shutter adapted to close off an area comprises a shutter curtain movable from an up position to a closed position, wherein the shutter curtain closes off the area when in the closed position, and at least one retractable guide, movable from a retracted position to an extended position and having a camber. The shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position.

In accordance with another aspect, the shutter curtain comprises front slats and rear slats, and an insulation package is deployable from a non-deployed position to a deployed position within a space between the front slats and the rear slats.

From the foregoing disclosure and the following more detailed description of various embodiments it will be apparent to those skilled in the art that the present invention provides a significant advance in the technology of fire shutters. Particularly significant in this regard is the potential the invention affords for providing a high quality, low cost fire shutter resistant to heat transfer. Additional features and advantages of various embodiments will be better understood in view of the detailed description provided below.

Figure 1:
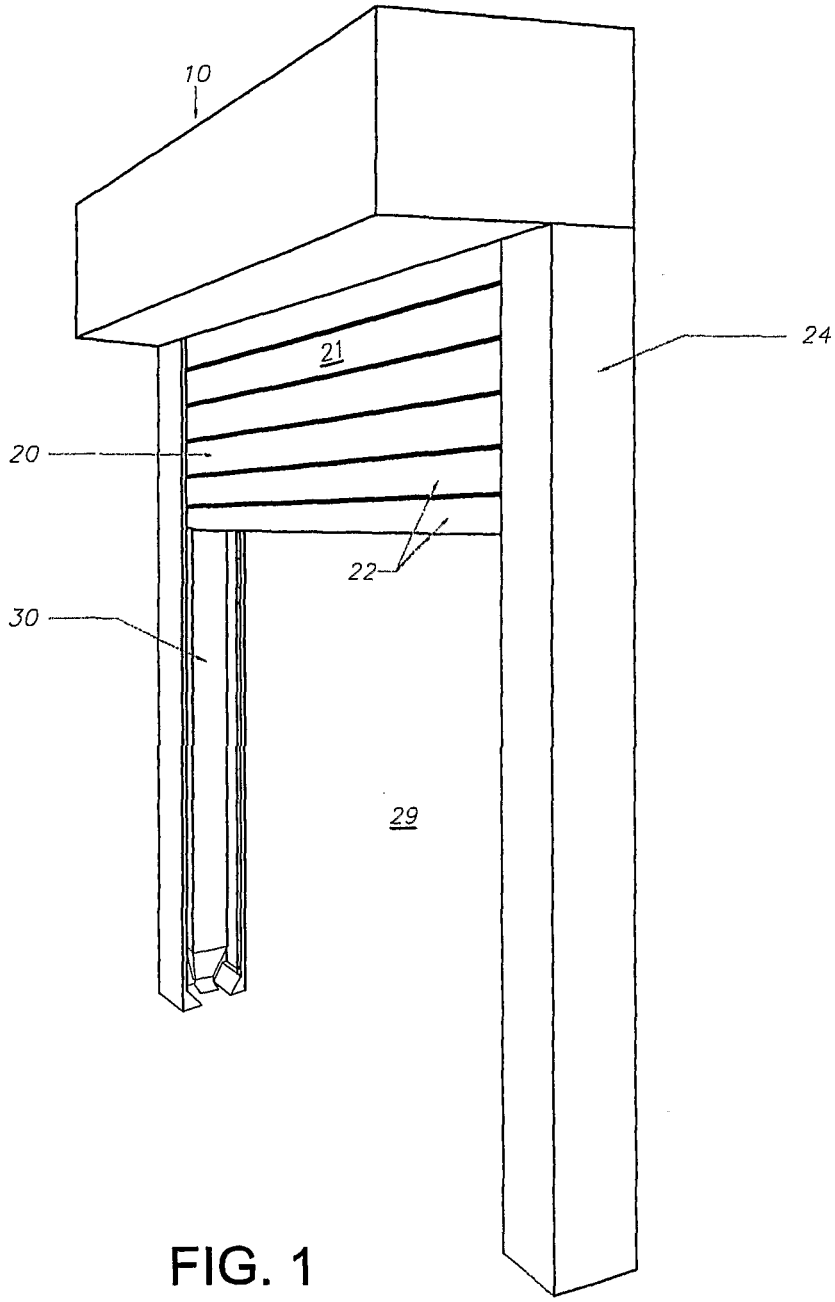
FIG. 1 is an isometric view of a fire shutter in accordance with one embodiment, shown positioned in a doorway.

It should be understood that the appended drawings are not necessarily to scale, presenting a somewhat simplified representation of various features illustrative of the basic principles of the invention. The specific design features of the fire shutter as disclosed here, including, for example, the specific dimensions of the slats, will be determined in part by the particular intended application and use environment. Certain features of the illustrated embodiments have been enlarged or distorted relative to others to help provide clear understanding. In particular, thin features may be thickened, for example, for clarity of illustration. All references to direction and position, unless otherwise indicated, refer to the orientation illustrated in the drawings.

DETAILED DESCRIPTION OF CERTAIN EMBODIMENTS

It will be apparent to those skilled in the art, that is, to those who have knowledge or experience in this area of technology, that many uses and design variations are possible for the fire shutter disclosed here. The following detailed discussion of various alternate features and embodiments will illustrate the general principles of the invention with reference to a fire shutter suitable for use closing a doorway. Other embodiments suitable for other applications will be apparent to those skilled in the art given the benefit of this disclosure.

Turning now to the drawings, FIG. 1 shows an insulated fire shutter 10 in accordance with one embodiment positioned in a frame 24, such as the frame of a door or other space separating element. The fire shutter 10 has a shutter curtain 20 which is deployable from an up position where the shutter curtain is retracted to a closed position, where the shutter curtain closes off an area 29 defined by the frame 24. The shutter curtain may be maintained in the up position by mounting above the area 29 to be closed off, for example, as shown in the Figs. Shutter curtain 20 can comprise a plurality of slats 22. The slats 22 are pivotably connected to one another, as shown. Each slat 22 is an elongate member which extends between sides of the frame. The slats can comprise, for example, fire and heat resistant materials such as an exterior skin made of galvanized steel and an infill made of a ceramic fiber. Other combinations of materials suitable for use in such slats will be readily apparent to those skilled in the art given the benefit of this disclosure.

Figure 3:
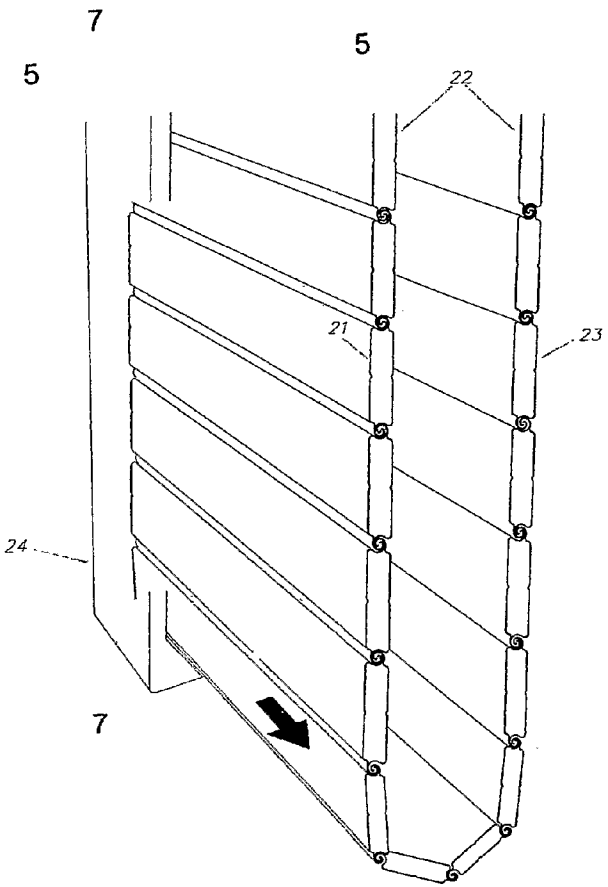
FIG. 3 is an isometric view of the fire shutter of FIG. 1, shown with a shutter curtain lowered past the camber.
Figure 2:
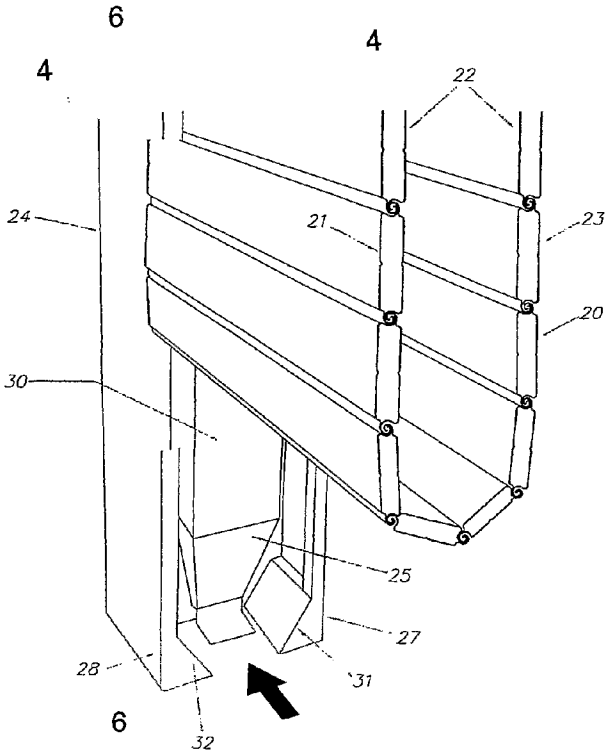
FIG. 2 is an isometric view of the fire shutter of FIG. 1, shown with a shutter curtain lowered to a point above a camber.
Figure 5:
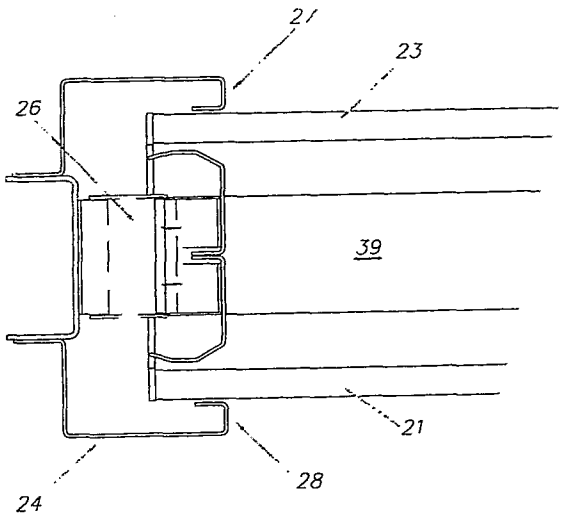
FIG. 5 is a cross section view taken through line 5-5 in FIG. 3, showing the shutter curtain and the retractable guide in an extended position.
Figure 4:
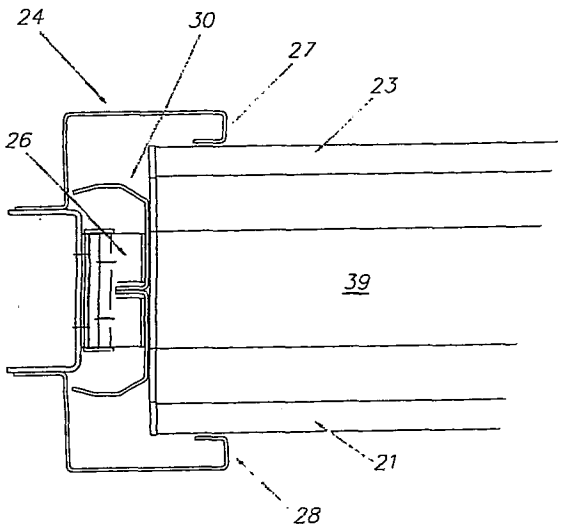
FIG. 4 is a cross section view taken through line 4-4 in FIG. 2, showing the shutter curtain and a retractable guide in a retracted position.
Figure 7:
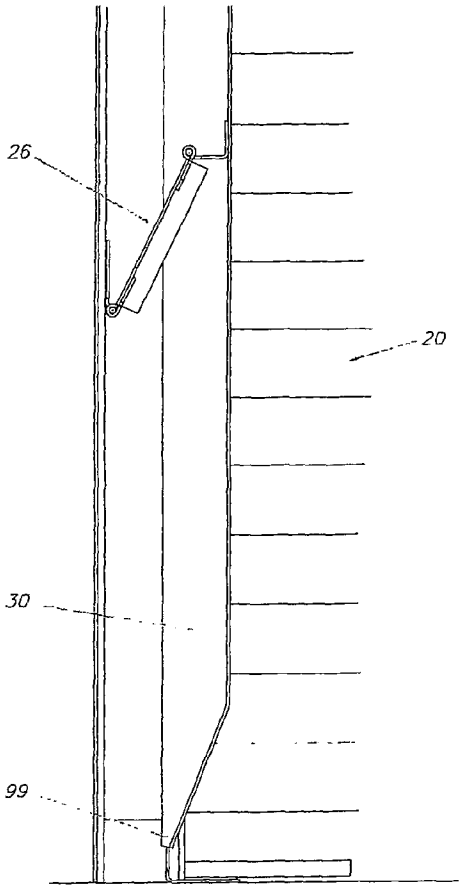
FIG. 7 is a cross section view taken through line 7-7 in FIG. 3, showing the retractable guide in the extended position.
Figure 6:
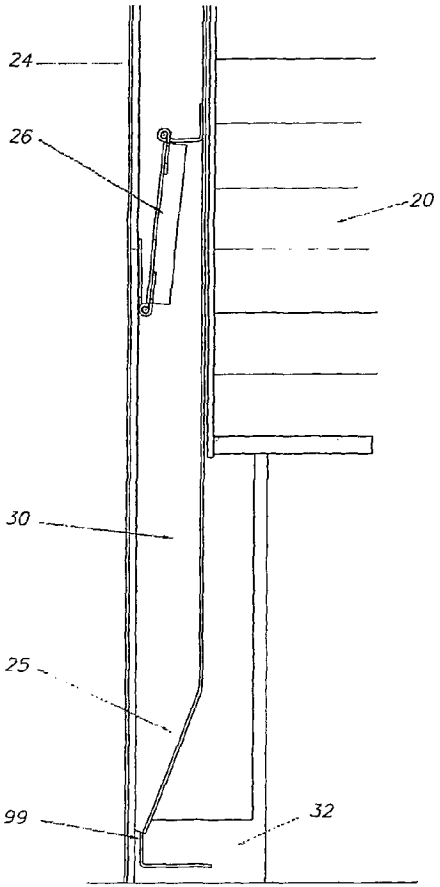
FIG. 6 is a cross section view taken through line 6-6 in FIG. 2, showing the retractable guide in the retracted position.

FIG. 2 shows the shutter curtain 20 which has moved in a first direction from the up position to an intermediate position close to the closed position. The shutter curtain has front slats 21 and rear slats 23, and a space 39 between the front slats 21 and the rear slates 23. As shown in FIGS. 2 and 3, one or two slats form a bend connecting the front slats to the rear slats, and help define space 39. Space 39 between the front slats 21 and the rear slats 23 is advantageous in helping to reduce heat transfer from one side where a fire would be to the other side which does not have a fire.

FIGS. 4-7 are various section views of the fire shutter showing the interrelationship between the shutter curtain 20 and a retractable guide 30 mounted on the frame 24. The retractable guide 30 has a ramped surface or camber 25 extending at a lower end 99. Also, the retractable guide is biased by a biasing member or pivoting linkage 26 mounted between the frame 24 and the guide 30. Pivoting linkage 26 biases the retractable guide 30 toward an extended position. However, in accordance with a highly advantageous feature, the slats of the shutter curtain resist this biasing force, and force the retractable guide 30 to stay in a retracted position (shown in FIGS. 2, 4 and 6) as long as the slats engage the retractable guide. This occurs while the shutter curtain is in the up position, and as it travels along the first direction toward the closed position. The camber 25 becomes progressively thinner towards the lower end. Once the bend of slats reaches the camber 25, the slats no longer provide a counteracting force to the retractable guide. Thus, the retractable guide is free to move in a second direction generally perpendicular to the first direction, to the extended position.

Frame 24 defines a pair of flanges 27, 28 which extend towards one another. Each flange 27, 28 has a corresponding ramped foot 31, 32, respectively, adjacent the lower end of the retractable guide 30, best seen in FIG. 2. When the retractable guide is in the closed position (FIGS. 3, 5 & 7), the ramped feet 31, 32 bias the front slats 21 and rear slats 23 toward one another, effectively providing a wedging effect to hold the shutter curtain firmly in the closed position. Significant temperature variations of a fire can induce air flow which can transmit fire and heat. It is highly desirable to provide a fire shutter which resists such air flow. As shown in FIG. 1, a second retractable guide may be used, one on each side of the frame 24, which works in the same manner as the first retractable guide in combination with a second pair of flanges on the frame. The second retractable guide is movable from a retracted position to an extended position, is attached to the frame, just like the first retractable guide. As can be seen in FIG. 1, the second retractable guide faces the first retractable guide. The retractable guides cooperate with the shutter curtain to close off the area when the shutter curtain is in the closed position.

Figure 9:
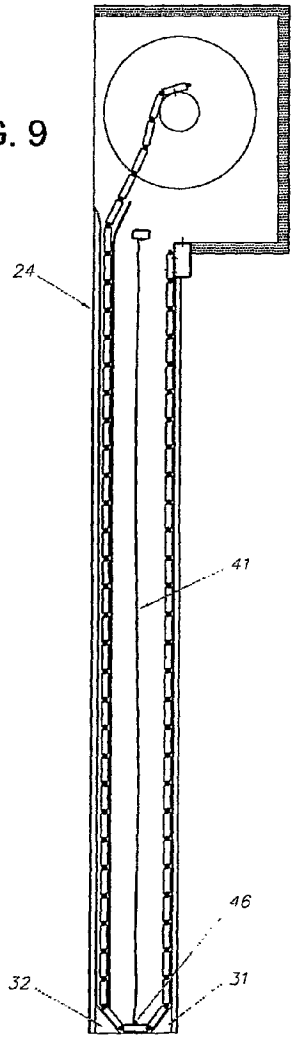
FIG. 9 is a side view showing the insulation package in a deployed position.
Figure 8:
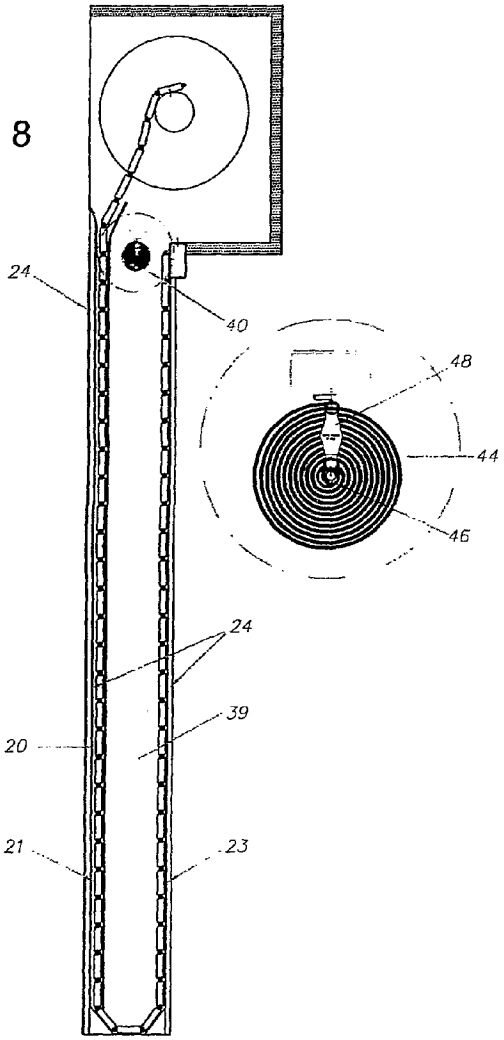
FIG. 8 is a side view showing an insulation package within a space within the shutter curtain in an initial position.

FIGS. 8 and 9 show another advantageous feature of the invention. An insulation package 40 is provided which is deployable from a non-deployed position (FIG. 8) to a deployed position (FIG. 9) in the space 39 between the front slats 21 and the rear slats 23. The insulation package 40 can be mounted on a suspended roll 44. During rotation of the roll the insulation package moves from the non-deployed position to the deployed position. The insulation package 40 comprises an insulating material 41 resistant to heat transfer. The insulating material can comprise, for example, an aluminized coated fiberglass cloth, or simply an aluminised fiberglass, a silica, etc. Other insulating materials suitable for use as an insulation package will be readily apparent to those skilled in the art given the benefit of this disclosure.

The insulation package 40 is seen to comprise a sheet of insulating material which can extend into the space 39 to help resist heat transfer. In accordance with a highly advantageous feature, the insulation package is provided with a link attached to hold the insulation package in the non-deployed position. The link may be a fusible link which is temperature sensitive so that above a predetermined temperature the link breaks and allows the insulation package to move to the deployed position. Thus, the insulation package may not deploy at all unless the environment gets too hot. In such circumstances the shutter curtain will have been moved to the closed position, as shown. Optionally a weight such as weight bar 46 may be added to increase the force of gravity urging the insulation package to the deployed position.

From the foregoing disclosure and detailed description of certain preferred embodiments, it will be apparent that various modifications, additions and other alternative embodiments are possible without departing from the true scope and spirit of the invention. The embodiments discussed were chosen and described to provide the best illustration of the principles of the invention and its practical application to thereby enable one of ordinary skill in the art to use the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A fire shutter adapted to close off an area, the fire shutter comprising:

a shutter curtain movable within a frame from an up position to a closed position, wherein the shutter curtain closes off the area when in the closed position; and at least one retractable guide, located within the frame and movable from a retracted position to an extended position and having a camber;

wherein the shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position;

wherein the frame defines at least a first pair of flanges which extend toward each other, and the shutter curtain comprises front slats connected to rear slats and wherein the flanges overlie opposed end portions of the front and rear slats of the shutter curtain; and wherein the at least one retractable guide has a lower end, each flange has a ramped foot adjacent the lower end, and the front slats and rear slats are biased toward each other by the ramped feet when the shutter curtain is in the closed position.

2. The fire shutter of claim 1 wherein each slat comprises an exterior skin surrounding an infill.

3. The fire shutter of claim 1 wherein the shutter curtain travels in a first direction as the shutter curtain moves from the up position to the closed position, and the at least one retractable guide moves in a second direction which intersects the path of travel of the first direction when the at least one retractable guide moves from the retracted position to the extended position.

4. The fire shutter of claim 1 further comprising a biasing member operatively connected between the frame and the at least one retractable guide, wherein the biasing member biases the at least one retractable guide toward the extended position.

5. The fire shutter of claim 3 wherein the second direction of the at least one retractable guide is in the form of an arc.

6. The fire shutter of claim 1 further comprising an insulation package independently deployable of the shutter curtain from a non-deployed position to a deployed position within a space between the front slats and the rear slats.

7. A fire shutter adapted to close off an area, the fire shutter comprising:

a shutter curtain movable within a frame from an up position to a closed position, wherein the shutter curtain closes off the area when in the closed position; and at least one retractable guide, located within the frame and movable from a retracted position to an extended position and having a camber;

wherein the shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position; and wherein the camber is an extension of the at least one retractable guide, and the camber becomes progressively thinner towards a lower end.

8. The fire shutter of claim 7 wherein the frame defines at least a first pair of flanges which extend toward each other, and the shutter curtain comprises front slats connected to rear slats and wherein the flanges overlie opposed end portions of the front and rear slats of the shutter curtain.

9. The fire shutter of claim 7 wherein the shutter curtain comprises front slats and rear slats, and an insulation package independently deployable of the shutter curtain from a non-deployed position to a deployed position within a space between the front slats and the rear slats.

10. The fire shutter of claim 7 further comprising a second retractable guide movable from a retracted position to an extended position, located within the frame and facing the at least one retractable guide, wherein movement of the respective guides from their retracted to their extended position is in the form of an arc and in so doing, the retractable guides cooperate with the shutter curtain to close off the area when the shutter curtain is in the closed position.

11. The fire shutter of claim 7 wherein the shutter curtain comprises a series of pivotably connected slats and wherein each slat comprises an exterior skin surrounding an infill.

12. A fire shutter adapted to close off an area, the fire shutter comprising:

a shutter curtain movable within a frame from an up position to a closed position, wherein the shutter curtain closes off the area when in the closed position; and at least one retractable guide, located within the frame and movable from a retracted position to an extended position and having a camber;

wherein the shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position;

wherein the shutter curtain comprises front slats and rear slats, and an insulation package independently deployable of the shutter curtain from a non-deployed position to a deployed position within a space between the front slats and the rear slats; and wherein the insulation package comprises an insulating material comprising one of silica and aluminized fiberglass.

13. The fire shutter of claim 12 wherein each slat comprises an exterior skin surrounding an infill.

14. A fire shutter adapted to close off an area, the fire shutter comprising:

a shutter curtain movable within a frame from an up position to a closed position, wherein the shutter curtain closes off the area when in the closed position; and at least one retractable guide, located within the frame and movable from a retracted position to an extended position and having a camber;

wherein the shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position;

wherein the shutter curtain comprises front slats and rear slats, and an insulation package independently deployable of the shutter curtain from a non-deployed position to a deployed position within a space between the front slats and the rear slats; and wherein the insulation package is attached to a suspended roll, and during rotation of the roll the insulation package moves from the non-deployed position to the deployed position and only contacts the shutter curtain once it has been fully deployed.

15. The fire shutter of claim 14 further comprising a weight bar attached to the insulation package, wherein the weight bar urges the insulation package toward the deployed position.

16. The fire shutter of claim 14 further comprising a link attached to the insulation package which holds the insulation package in the non-deployed position, wherein the link is temperature sensitive so that above a pre-determined temperature the link breaks and allows the insulation package to move to the deployed position.

17. The fire shutter of claim 14 wherein each slat comprises an exterior skin surrounding an infill.

18. A fire shutter adapted to close off an area, the fire shutter comprising:

a shutter curtain movable within a frame from an up position to a closed position, wherein the shutter curtain closes off the area when in the closed position; and at least one retractable guide, located within the frame and movable from a retracted position to an extended position and having a camber;

wherein the shutter curtain engages the at least one retractable guide as the shutter curtain moves from the up position toward the closed position, biasing the at least one retractable guide to the retracted position, and in the closed position the shutter curtain engages the camber and allows the at least one retractable guide to move to the extended position;

wherein the frame defines at least a first pair of flanges which extend toward each other, and the shutter curtain comprises front slats connected to rear slats and wherein the flanges overlie opposed end portions of the front and rear slats of the shutter curtain; and wherein the shutter curtain travels in a first direction as the shutter curtain moves from the up position to the closed position, and the at least one retractable guide moves in a second direction which intersects the path of travel of the first direction when the at least one retractable guide moves from the retracted position to the extended position and when the at least one retractable guide is in its extended position, it acts to keep the front and rear slats of the shutter curtain apart.

19. The fire shutter of claim 18 wherein the second direction of the at least one retractable guide is in the form of an arc.

20. The fire shutter of claim 18 wherein each slat comprises an exterior skin surrounding an infill.

21. The fire shutter of claim 18 further comprising an insulation package independently deployable of the shutter curtain from a non-deployed position to a deployed position within a space between the front slats and the rear slats.

* * * * *